US005357727A

United States Patent [19]

Duckworth et al.

[11] Patent Number: 5,357,727

[45] Date of Patent: Oct. 25, 1994

[54] EXPANSION JOINT

[75] Inventors: Glen Duckworth, Arlington, Tex.; Bill Heisterberg, Casa Grande, Ariz.; Mark Honstra, San Ramon, Calif.; Trest Polina, Norman, Okla.; Stephen Newcomb, Moore, Okla.; Henry Gohlke, Norman, Okla.

[73] Assignees: Balco/Metalines, Inc., Wichita, Kans.; Hexcel Corporation, Pleasanton, Calif.

[21] Appl. No.: 91,872

[22] Filed: Jul. 14, 1993

[51] Int. Cl.[5] ..... E01C 11/12

[52] U.S. Cl. ..... 52/396.06; 52/396.04; 52/396.05; 52/573.1; 404/47

[58] Field of Search ..... 52/573.1, 396.04, 396.05, 52/396.06; 404/47

[56] References Cited

U.S. PATENT DOCUMENTS

| | | | |
|---|---|---|---|
| 3,331,176 | 7/1967 | Washam | 52/396.05 X |
| 3,417,528 | 12/1968 | Hallock | 52/396.05 X |
| 3,974,609 | 8/1976 | Attaway | 52/396.05 X |
| 4,141,189 | 2/1979 | Borjeson | 52/396.06 |
| 4,148,167 | 4/1979 | Puccio | 52/396.06 |
| 4,362,428 | 12/1982 | Kerschner | 52/396.06 X |
| 4,885,885 | 12/1989 | Gottschling | 52/396.05 |
| 4,893,448 | 1/1990 | McCormick | 52/396.05 |
| 4,914,884 | 4/1990 | Ohmatsu | 52/396.05 |
| 5,067,297 | 11/1991 | Sobol | 52/396.05 |
| 5,319,907 | 6/1994 | Nicholas | 52/396.05 |

*Primary Examiner*—Carl D. Friedman
*Assistant Examiner*—Beth A. Aubrey
*Attorney, Agent, or Firm*—Hovey, Williams, Timmons & Collins

[57] ABSTRACT

An improved expansion joint assembly (10, 70) is provided for bridging an expansion void (12, 72) between adjacent, relatively shiftable structural sections (14, 6, 74, 76). The assembly (10, 70) includes a pair of supports (18, 20, 78, 80) respectively secured to the sections (14, 16, 74, 76), as well as a bridging member (22, 82) operatively engaging the supports (18, 20, 78, 80). A resilient compressible filler (24, 128, 130) is located between a bridging member (22, 82) and adjacent portions of the supports (18, 20, 78, 80). The filler (24, 128, 130) is preferably in the form of a compressible, resilient body including walls (62) defining a series of openings (64), so that the filler can accommodate significant movement without bulging or failure.

9 Claims, 3 Drawing Sheets

EXPANSION JOINT

BACKGROUND OF THE INVENTION

1. Field of the Invention

The present invention is broadly concerned with an improved expansion joint assembly adapted for bridging adjacent, elongated, relatively shiftable structural sections in order to accommodate normal settling or other movement of the sections. More particularly, the invention is concerned with such an expansion joint assembly having as a part thereof a filler in the form of a compressible, resilient body including a plurality of walls defining a series of openings in the body permitting the latter to alternately compress and expand in response to movement of the assembly. This allows full and free movement of the expansion joint which is not possible using conventional thick-walled filler strips which allow only limited movement and are subject to bulging when compressed.

2. Description of the Prior Art

Expansion joints have long been used in floors and walls of buildings in order to accommodate normal relative shifting movement occurring by virtue of settling or thermal cycling. In the case of floor expansion joints, such have included a pair of extruded aluminum supports fixed to adjacent joint-defining structural sections, together with a bridging member in overlying relationship to the joint and operatively engaging the space supports. These assemblies are constructed so as to permit relative movement between the bridging member and adjacent supports, thereby insuring that the joint is covered at all times and does not present a hazard to traffic.

Many types of prior expansion joints makes use of filler strips between the rigid extruded aluminum supports and the bridging cover. These fillers are typically formed of thick-walled elastomeric material in order to support traffic loads. However, this construction inherently means that the range of movement of the expansion joint assembly is restricted. Moreover, these fillers tend to bulge when compressed, causing a traffic hazard.

There is accordingly a real need in the art for an improved expansion joint assembly making use of a thin-walled filler which not only permits essentially complete movement of the assembly but also avoids the problem of bulging when the filler is compressed.

SUMMARY OF THE INVENTION

The present invention overcomes the problems outlined above and provides an improved expansion joint preferably including a perforate, resilient compressible filler in lieu of conventional elastomeric fillers.

Broadly speaking, the expansion joint assembly of the invention includes a pair of elongated supports respectively coupled to a pair of adjacent structural sections cooperatively defining therebetween an expansion void of nominal width. An elongated bridging member presenting a pair of side margins and having a width greater than the nominal width of the expansion void is also provided, with each of the side margins operatively engaging a corresponding support for spanning the void. In addition, a space is provided between at least one of the margins of the bridging member and adjacent portions of the corresponding support for accommodating movement of the bridging member during shifting of the structural sections. A filler is disposed within this space and comprises a compressible, resilient body including a plurality of walls defining a series of openings in the body, so that the latter may alternately compress and expand in response to relative movement between the bridging member and supports.

In more detail, the filler is advantageously a honeycomb material comprising a plurality of serpentine walls each presenting a series of alternating, oppositely directed peaks along the lengths thereof, with the walls being connected peak-to-peak to define a series of cells between the walls. This type of honeycomb material is commercially available as commercial grade honeycomb, sold by Hexcel, Inc. of Pleasanton, Calif.

In actual practice, a cover may be disposed over the perforate filler, but given the strength of the latter the cover need only be a light metallic (e.g., aluminum) plate.

DETAILED DESCRIPTION OF THE PREFERRED EMBODIMENTS

Figure 2:
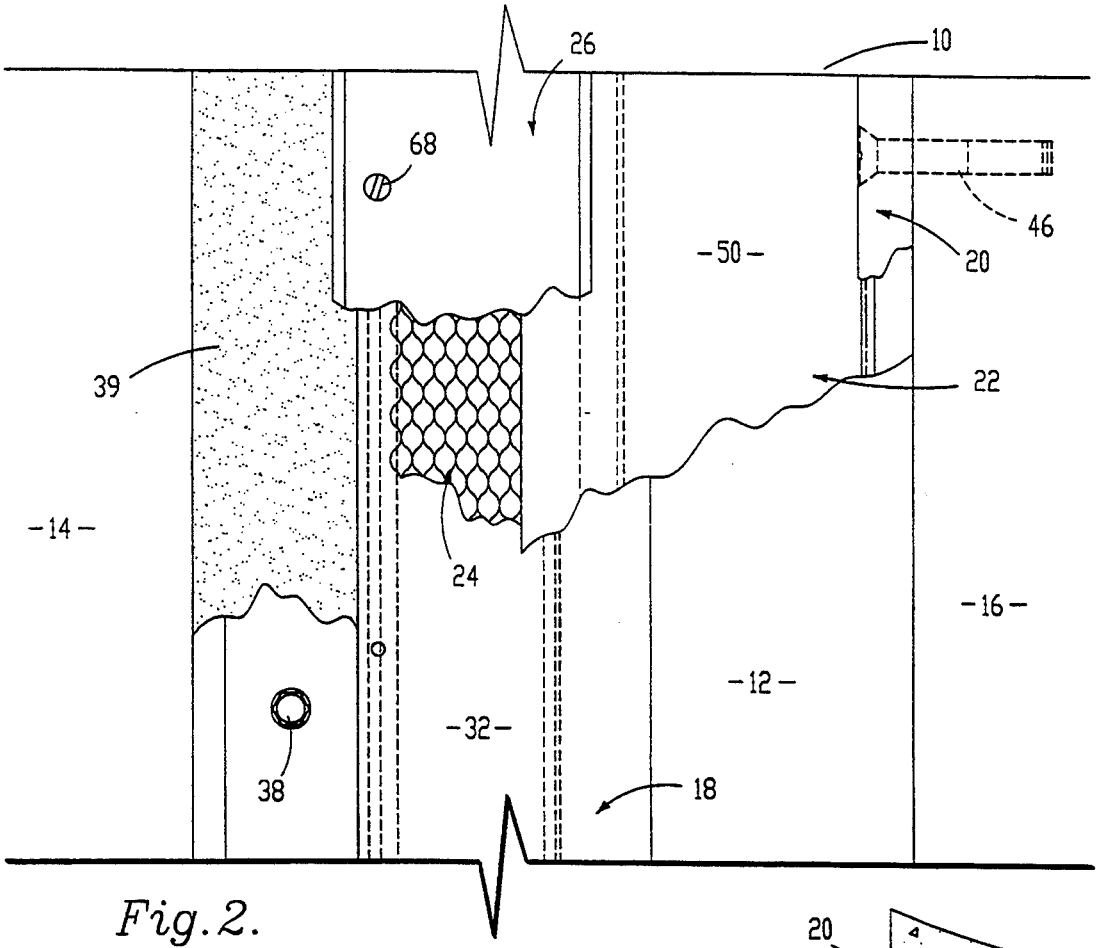
FIG. 2 is a fragmentary plan view of the assembly illustrated in FIG. 1 with parts broken away for clarity and certain parts being shown in phantom.
Figure 1:
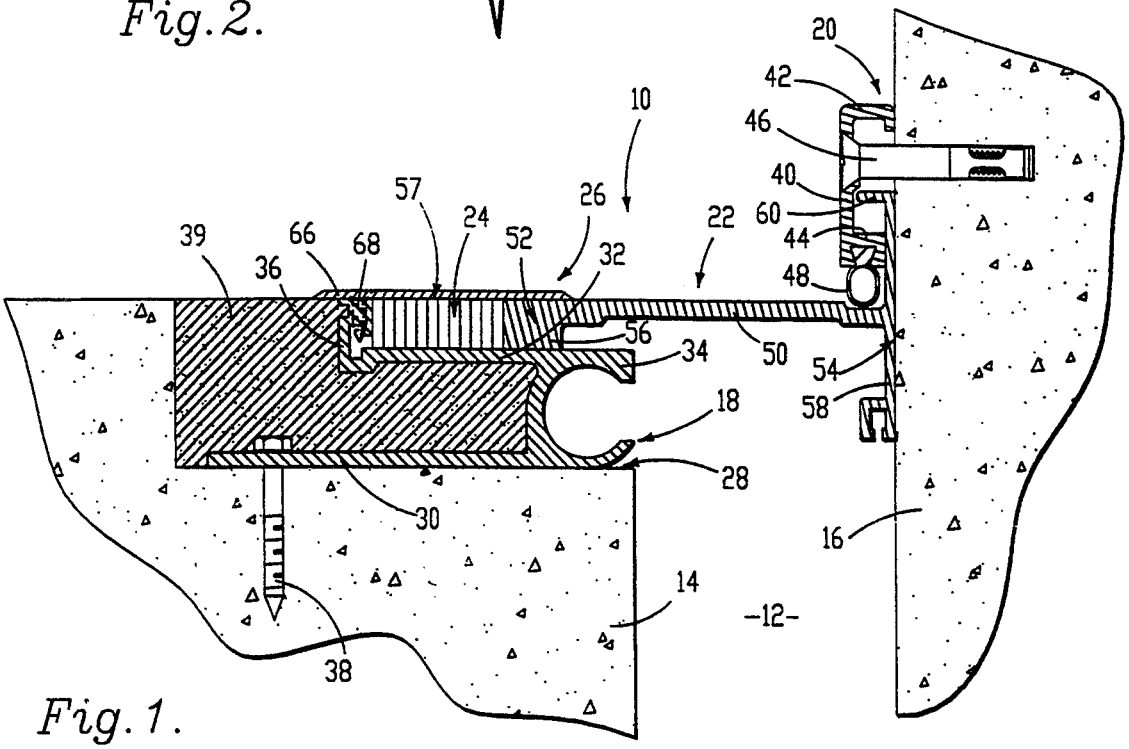
FIG. 1 is a fragmentary vertical sectional view of a corner expansion joint assembly in accordance with the invention operably coupled between a wall and floor.

Turning now to the drawings, and particularly FIGS. 1–2, a corner expansion joint assembly 10 is illustrated. The assembly 10 is adapted to cover an expansion void 12 defined between a pair of structural sections, namely floor section 14 and adjacent wall section 16.

Broadly speaking, the assembly 10 includes a pair of elongated, extruded aluminum supports 18, 20 respectively coupled to the sections 14, 16, an elongated, extruded aluminum bridging member 22, resilient filler 24 and lightweight aluminum filler cover 26.

In more detail, support 18 is adapted to be positioned within a rectangular cutout region 28 in floor section 14, and includes a lowermost, apertured, floor section-engaging web 30 as well as an upper web 32 spaced above the web 30 as shown. The righthand end of support 18 is in the form of an elongated, generally C-shaped section 34 integral with the webs 30, 32. The end of support 18 remote from void 12 is in the form of an upstanding, elongated apertured sidewall 36. The support 18 is secured to floor section 14 by means of plural threaded fasteners 38 extending through lower web 30. Conventional grout 39 is employed to fill the remainder of the cutout region 28 of the section 14 as depicted.

Support 20 is adapted for coupling to wall section 16 and includes an elongated channel member 40 presenting a planar outer section as well as a pair of inwardly extending legs 42, 44. A plurality of fasteners 46 extending through the outer section of the channel member 40 and into wall section 16 are employed for securing support 20 in place. It will be noted in this respect that leg 42 is in direct engagement with wall section 16, whereas a space is provided between the inner butt end of leg 44 and wall section 16. Moreover, a resilient, elongated bladder 48 is secured to leg 40 and extends downwardly therefrom.

Bridging member 22 is designed to cover the expansion void 12 as best seen in FIG. 1. To this end, the expansion member includes an elongated, rigid metallic (aluminum) plate 50 having a width greater than the nominal width of void 12 and presenting a pair of integral side margins 52, 54 respectively adapted for engaging the corresponding supports 18, 20. In particular, the side margin 26 is in the form of a block 56 whose underside is adapted to freely slide along the upper surface of web 32. A space 57 is therefore defined between the lefthand face of block 56 and the adjacent face of sidewall 36.

Side margin 54 on the other hand is in the form of an elongated web 58 oriented transverse to plate 50. The upper end of web 58 presents an outwardly extending locking rib 60, with the web 58 extending through the opening between leg 44 and section 14 and into the confines of channel member 40.

Figure 5:
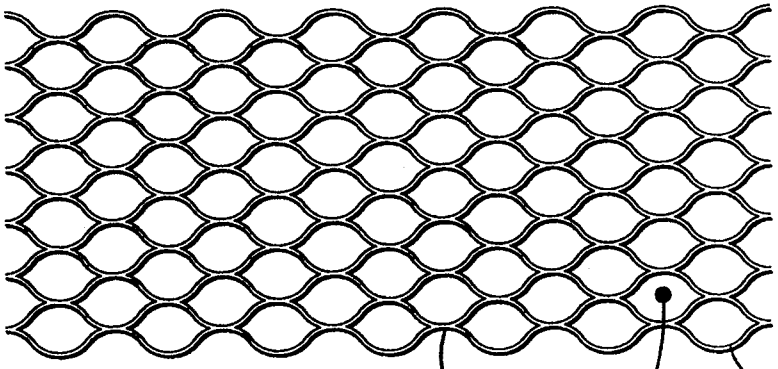
FIG. 5 is an enlarged plan view of a portion of the preferred honeycomb filler used in the expansion joint assemblies of the invention.

Filler 24 is best illustrated in FIG. 5, where it will be seen that the filler includes a plurality of side-by-side webs 62 each presenting along the length thereof a series of alternating, oppositely directed peaks 62*a*. The webs 62 are interconnected peak-to-peak in order to define a large number of voids 64. In plan configuration, the filler 24 is at least about 90% voids, thereby allowing the filler to undergo significant compression. By the same token, by virtue of the construction of the honeycomb-like filler, it resiliently expands when compressive forces are reduced. As will be readily apparent from a study of FIGS. 1, 2 and 5, the filler 24 is oriented with the respective webs 62 extending along the length of the space 57 between side margin 52 and sidewall 36.

The most preferred filler material is the commercially available HRH-78 Nomex commercial grade honeycomb sold by Hexcel, Inc. of Pleasanton, Calif. This material is described in Hexcel Data Sheet 4400, which is incorporated by reference herein. Various sizes of this HRH-78 material may be used in the context of the invention.

Cover 26 is in the form of an elongated, thin metallic (e.g., $\frac{1}{8}$" thick) plate 66 having a width sufficient to cover space 57 and engage the upper surface of block 56 and side margin 36. The plate 66 is secured in place by means of a plurality of metal screws 68 extending into side margin 36 as shown.

In use, the assembly 10 is operable to accommodate relative shifting between the sections 14, 16. During such shifting, the respective side margins 52, 54 of the bridging member 22 will move relative to the fixed supports 18 and 20. This may cause movement of side margin 52 toward and away from sidewall 36, i.e., the width of space 57 may vary. In such a case, the filler 24 serves to compress or expand as necessary to maintain its position within the space 57. The filler 24 is very strong and resists crushing under traffic loads. At the same time, significant compression of the filler causes essentially no bulging or upward movement thereof, thereby eliminating one of the significant problems with prior elastomeric fillers.

Figure 3:
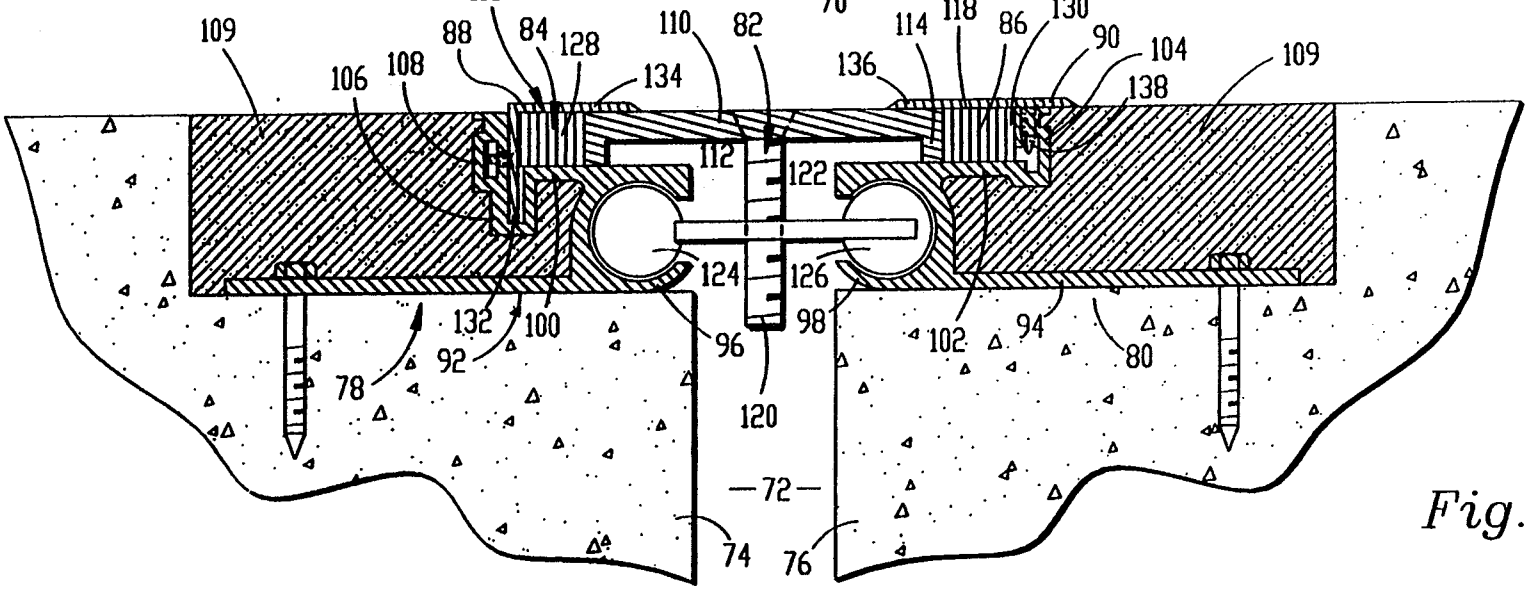
FIG. 3 is a vertical sectional view of a floor expansion joint assembly pursuant to the invention and operably coupled between a pair of adjacent floor sections.
Figure 4:
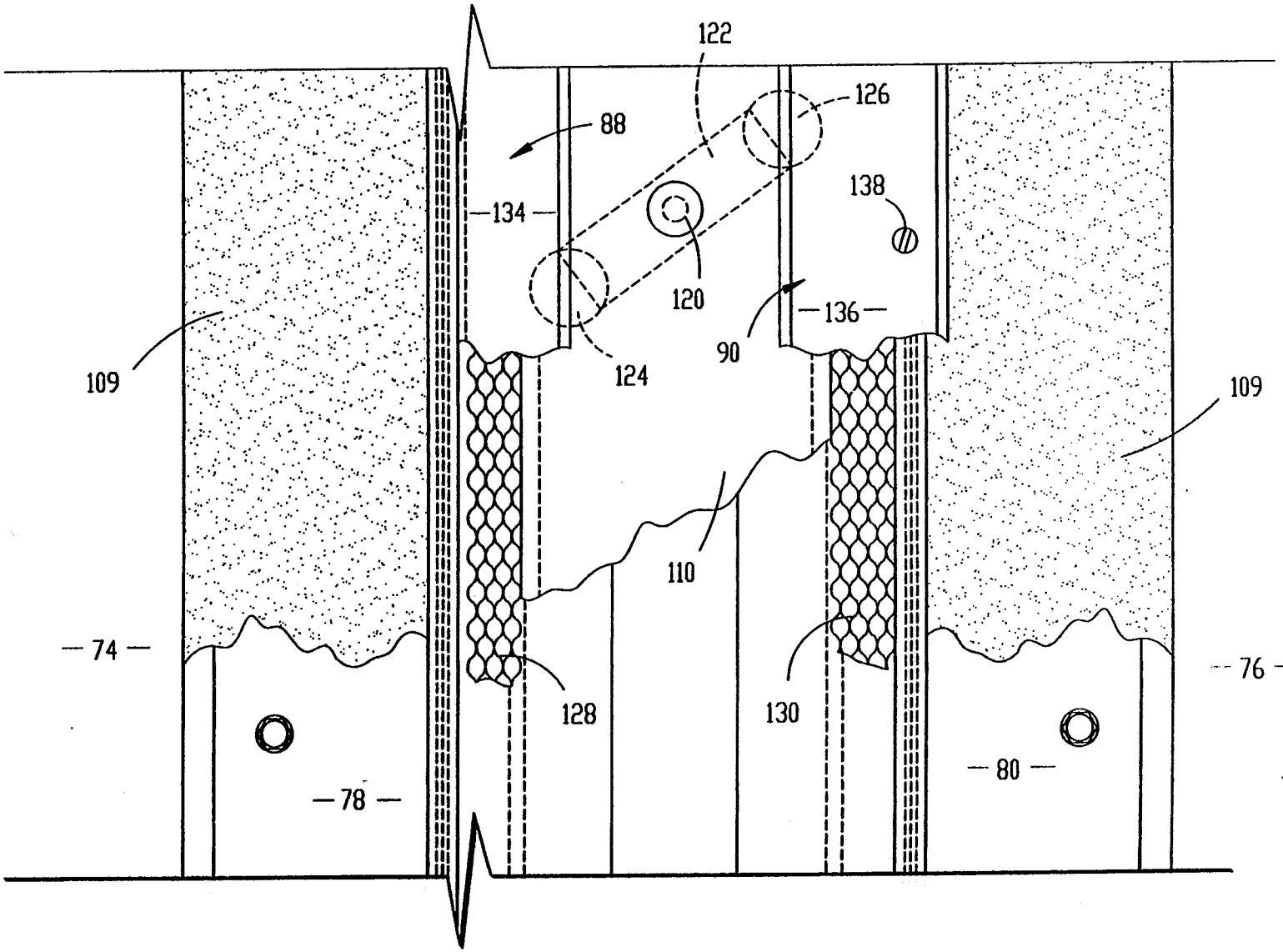
FIG. 4 is a fragmentary plan view of the assembly depicted in FIG. 3, with parts broken away for clarity and certain parts shown in phantom.

FIGS. 3–4 illustrate a similar expansion joint assembly 70 adapted for covering a void 72 between a pair of adjacent floor sections 74, 76. Again, the assembly 70 includes a pair of rigid metallic supports 78, 80 respectively secured to the sections 74, 76, as well as bridging member 82 operatively coupled with the supports and bridging void 72. In this instance, a pair of fillers 84, 86 are used, along with corresponding filler plates 88, 90.

The integral metallic supports 78 and 80 are very similar, each including a lowermost web 92, 94, C-shaped sections 96, 98 and upper webs 100, 102. Upper web 102 terminates in an upstanding sidewall 104 as depicted, whereas a depending, generally, elongated U-shaped segment 106 is provided at the inner end of web 100; an inner sidewall 108 extending upwardly from segment 106 completes the support 78. Grout 109 is used to fill the cutout regions of the sections 74, 76 where the supports 78, 80 are attached.

Support member 82 is in the form of an elongated, apertured metallic plate 110 of width sufficient to span the width of void 72 and having a pair of depending side margins 112, 114 respectively and slidably engaging the upper webs 100, 102. A pair of elongated spaces 116, 118 are thereby defined between side margin 112 and sidewall 108, and between side margin 114 and sidewall 104.

A plurality of screws 120 extend through plate 110 and into void 72 as best seen in FIG. 3. Each of the screws 120 is in turn connected with a laterally extending connector 122, the latter being operatively secured with ball-like elements 124, 126 respectively disposed within the C-shaped sections 96, 98. The connector 122 and elements 124, 126 serve as a guide and assist the assembly in conforming with the relative movement of sections 74, 76.

Two separate fillers 128, 130 are used in conjunction with assembly 70, i.e., the filler 128 is located within space 116, and filler 130 is within space 118. The fillers 128, 130 are identical with filler 24 described with reference to assembly 10.

Filler plate 88 is a thin metallic member and presents a depending leg 132 extending downwardly along the length of sidewall 108 and into U-shaped segment 106. A laterally extending section 134, integral with leg 132, extends across the top of filler 128 and engages the upper surface of plate 110. Filler 86 on the other hand is in the form of a planar metallic plate member 136 which is secured to sidewall 104 by means of metal screws 138. The plate 136 likewise engages the upper surface of plate 110 as shown, thereby covering the filler 130.

The operation of assembly 70, insofar as the function of fillers 128, 130 is concerned, is identical with that described with reference to assembly 10. That is, the respective fillers 128, 130 are compressed or expand in order to accommodate movement of the bridging member 82, all without bulging and while providing adequate support for normal traffic.

We claim:

1. An expansion joint assembly for bridging a pair of adjacent, elongated, relatively shiftable structural sections presenting therebetween an expansion void of nominal width, said assembly comprising:

a pair of elongated supports respectively coupled to said sections adjacent said void;

an elongated bridging member presenting a pair of side margins and having a width greater than the nominal width of said void, each of said side margins operatively engaging a corresponding support for spanning said void, there being a space between at least one of said side margins and adjacent portions of the corresponding support for accommodating movement of the bridging member during shifting of said sections; and a filler disposed within said space and comprising a compressible, resilient body including a plurality of walls defining a series of openings in the body permitting the latter to alternately compress and expand in response to relative movement between the member and supports.

2. The assembly of claim 1, said body comprising a plurality of serpentine walls each presenting a series of alternating, oppositely directed peaks along the lengths thereof, said walls being connected peak-to-peak to define a series of cells between the walls.

3. The assembly of claim 2, said walls being formed of synthetic resin paper material.

4. The assembly of claim 2, said body being coated with a phenolic resin.

5. The assembly of claim 1, said body in plan configuration being at least about 90% voids.

6. The assembly of claim 1, including a pair of spaces respectively located between each of said side margins and the adjacent portions of the corresponding supports, there being a respective filler body disposed within each of said spaces.

7. The assembly of claim 1, including a cover positioned over said filler body.

8. The assembly of claim 7, said cover comprising a metallic plate.

9. The assembly of claim 7, including means releasably connecting said cover with said corresponding support, said support having a width to cover said space and engage said one side margin.

* * * * *